US011215414B2

(12) United States Patent
Markut

(10) Patent No.: US 11,215,414 B2
(45) Date of Patent: Jan. 4, 2022

(54) FIREARM WITH GAS-OPERATED RELOADING

(71) Applicant: GLOCK TECHNOLOGY GMBH, Ferlach (AT)

(72) Inventor: Karl Markut, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 17/061,832

(22) Filed: Oct. 2, 2020

(65) Prior Publication Data

US 2021/0222976 A1 Jul. 22, 2021

(30) Foreign Application Priority Data

Oct. 4, 2019 (EP) ..... 19201451

(51) Int. Cl.
*F41A 5/28* (2006.01)
*F41A 5/24* (2006.01)

(52) U.S. Cl.
CPC . *F41A 5/28* (2013.01); *F41A 5/24* (2013.01)

(58) Field of Classification Search
CPC ..... F41A 5/26; F41A 5/28; F41A 5/24
See application file for complete search history.

(56) References Cited

U.S. PATENT DOCUMENTS 1,802,816 A * 4/1931 Holek ..... F41A 5/28 89/193
7,610,844 B2 11/2009 Kuczynko
7,856,917 B2 12/2010 Noveske
8,393,259 B2 3/2013 Larue
8,490,312 B2 * 7/2013 Barrett ..... F41A 3/26 42/75.02
8,596,185 B1 12/2013 Soong
8,813,632 B2 8/2014 Adams
8,869,674 B2 10/2014 Ruck
9,170,061 B2 10/2015 Gomez
9,335,106 B1 5/2016 Simon
9,410,756 B2 8/2016 Gardner
9,459,061 B2 10/2016 Cassels
9,803,941 B2 10/2017 Larue
2010/0186582 A1 * 7/2010 Juarez ..... F41A 5/28 89/191.01

(Continued)

FOREIGN PATENT DOCUMENTS

DE 102006056130 A1 2/2008
DE 202017003917 U1 * 9/2017 ..... F41A 5/28
EP 2210056 A2 5/2009

*Primary Examiner* — Gabriel J. Klein
(74) *Attorney, Agent, or Firm* — Raven Patents, LLC; Anton E. Skaugset

(57) ABSTRACT

Firearms, with gas-operated reloading, having a gas block that includes a gas pressure selector movable between at least two positions. For smooth operation, the gas pressure selector in the gas block is rotatable into at least two positions about its primary axis and is also designed to be axially displaceable along the same primary axis between at least two positions. The gas block includes a stop pin that is arranged to cooperate with a control surface of the gas pressure selector with complementary form and function, and further includes a locking device having a spring-loaded locking pin that can yield normally to the primary axis to temporarily lock the gas pressure selector in a predetermined position.

19 Claims, 5 Drawing Sheets

(56) References Cited

U.S. PATENT DOCUMENTS

| | | | | |
|---|---|---|---|---|
| 2014/0083286 | A1* | 3/2014 | Gomez | F41A 5/18 89/193 |
| 2015/0292825 | A1* | 10/2015 | Cassels | F41A 5/28 89/193 |
| 2016/0033218 | A1 | 2/2016 | Folkestad, II | |
| 2016/0209138 | A1* | 7/2016 | DeSomma | F41A 5/28 |
| 2016/0265860 | A1* | 9/2016 | Schilling | F41A 5/28 |
| 2017/0321978 | A1 | 11/2017 | Brannan | |

* cited by examiner

FIREARM WITH GAS-OPERATED RELOADING

TECHNICAL FIELD

The present disclosure relates to firearms, and in particular to firearms that employ gas-operated reloading mechanisms.

BACKGROUND

Many automatic firearms, such as the M4- or AR15-based systems, feature a reloading mechanism that is gas-powered. Upon firing, a small portion of the expanding gas that is used to propel the projectile from the barrel is diverted by means of at least one gas removal bore located in the vicinity of the muzzle, and guided via a gas block and a gas pipe in the direction of the breech block. The high energy of the gas pressure is used to unlock and open the breechblock and to eject the empty casing.

Using different types of ammunition can result in different gas pressures, which in turn varies the pressure of the gas diverted and delivered to the reloading mechanism, potentially interfering with reloading or placing unwanted stresses on the firearm. However, by adjusting pressure of the diverted gas as needed, the firearm can continue operating properly. The pressure of the diverted gas can be adjusted by any suitable mechanism, which may be referred to as a gas pressure selector. A variety of methods of adjusting the gas pressure in gas-operated firearms have been previously employed.

With direct gas-operated systems (direct impingement), the diverted gas is fed directly to the bolt carrier, which is set in motion due by the gas pressure. In a gas cylinder system, the gas is conveyed only to a gas cylinder with a piston, where the gas pressure is converted into mechanical energy and conducted by means of a linkage to the breech. The gas cylinder can be arranged close to the bolt carrier, and/or near the gas discharge bore or the gas block on the barrel.

One way to regulate the gas pressure of an automatic gas-operated firearm with a direct gas system is to provide an adjustable gas control element on the so-called "gas key" or gas return, which is fixed to the sliding block (bolt carrier). This is, for example, an adjusting screw which can be screwed into the gas key by twisting, thus effecting a constriction of the cross-section of the region through which gas flows—and thus a corresponding reduction in the gas pressure as well. For example, U.S. Pat. No. 9,803,941 B2 discloses such a gas control system on the gas key. The disadvantage in this case is that in order to actually adjust the gas pressure, the block carrier must be freely accessible, such that the firearm cannot be in the ready-to-use state. A quick and easy adjustment of the gas pressure is thus impossible for the user—especially in field. For field use, variations which have the gas pressure selector located on the gas key are disadvantageous, because the gas flow of the weapon is adjustable only in the disassembled state.

A further way to regulate the gas pressure of an automatic gas-operated firearm, either with a direct gas system or with a gas cylinder system, is to attach an adjustable gas control element to the gas block. For example, U.S. Pat. No. 8,393,259 B2 discloses a gas pressure control system in which a barrel has two gas discharge bores. The gas block, in turn, also has two corresponding gas bores which communicate with the gas discharge bores on the barrel, then later meet and together open into the gas tube. By means of an adjustable piston, one of the two bores in the gas block can be opened and closed. As a result, the gas pressure moving into the gas tube can be varied accordingly.

The disadvantage of the U.S. Pat. No. 8,393,259 B2 apparatus is the high number of necessary bores required, and the associated increased complexity of machining, which precludes cost-effective production. Also, the effort required for break-down and cleaning for maintenance is increased.

DE 10 2006 056 130 A1 discloses a gas-operated reloading mechanism in which the total effective quantity and/or the effective, built-up pressure can be modified by means of a rotatably mounted cylinder which has at least two radial through-bores with different diameters. This is accomplished by the appropriate rotation of the cylinder. In this case, one of the through-bores connects a gas discharge opening in the barrel with the actual reloading mechanism, while the other bores are sealed by the wall of the component surrounding the cylinder. If there are more than two bores, however, this system becomes less robust due to the intersecting bores. Also, given that the axis of rotation of the cylinder runs normal to the center plane of the weapon, it may not be apparent to a user which bore is currently active—particularly in the dark.

U.S. Pat. Nos. 8,813,632 B2 and 9,410,756 B2 disclose an adjusting screw in the gas block which constricts the diameter of the gas bore and thus regulates the gas flow. Such threaded components are expensive and susceptible to contamination.

In a further variant of a gas pressure control system on the gas block, there are slidable and displaceably mounted plate-shaped or cuboid bodies in the gas block, said slidable body openings, such as bores (which may be punched instead), having different diameters. This is disclosed in U.S. Pat. Nos. 8,596,185 B1, 7,610,844 B2 and, with a triangular geometry, in U.S. Pat. No. 9,335,106 B1, by way of example. The movement of these plates or cuboids brings the gas discharge bore of the barrel, and subsequently the gas bore in the gas block, into an overlapping position with one of the bores, which may, for example, differ in diameter (and optionally a section of the triangular geometry as well). The corresponding diameter of the bore in the displaceable body is smaller, or at most as large as the diameter of the corresponding gas discharge bore and/or the bore of the gas block, and thus determines the gas pressure resulting in the gas tube; the displacement can be performed manually or by means of screw drive.

The disadvantage of such systems is the gap surface area required by the plate shape, and the clearance necessary for the movement, which facilitates an undesirable escape of gas. This can negatively impact the shooter, for example permitting gas to escape to the rear, and/or producing unwanted illumination that can reveal the position of the shooter from positions to the side and behind the shooter. This must be avoided, particularly during field use.

Rotatable or screwable gas pressure selectors which are arranged on the gas block are very widely used. For example, the gas pressure selectors can regulate the flowing gas if the rotary movement of the gas pressure selector sets different bores with different diameters between the gas discharge bore and the gas tube. In some cases, selecting "no bore" can completely interrupt the gas flow, which of course means that the weapon no longer reloads automatically. See U.S. Pat. No. 9,170,061 B2, for example.

Such rotatable gas pressure selectors consist, for example, of a sleeve or hollow cylinder rotatably mounted around the gas tube and, for example, fixed to an adjusting knob. This fixation can be accomplished, for example, by a thread and/or a cross-pin. The rotatable sleeve has in its diameter at least one or more smaller and larger bores, which can be made to coincide with the gas bore by turning the adjusting knob. The diameter of the sleeve bore limits the flow rate and thus regulates the resulting gas pressure in the gas tube. U.S. Pat. No. 7,856,917 B2 discloses such a gas controller, in which the adjustment knob is connected to the sleeve with a cross-pin. In addition, ring seals and a spring-loaded snap mechanism, which must be actively triggered and held before turning, are included. Also, EP 2210056 A2 and U.S. Pat. No. 9,459,061 B2 describe sleeve-shaped and multi-part gas pressure selectors.

For example, US 2017321978 A1 discloses a hollow-cylindrical gas pressure selector which can be screwed into the gas tube by means of threads, with gas bores in the thread of different sizes which control the gas flow.

However, these gas pressure selectors are frequently only adjustable by means of a tool such as a screwdriver. Solutions that only allow for an adjustment of the gas pressure selector by means of tools are particularly disadvantageous for field use because, without an appropriate tool, the gas pressure cannot be adjusted. US 2016033218 A1 discloses a gas pressure selector which is adjustable by means of a tool such as a screwdriver. However, variants with valves are also possible—such as U.S. Pat. No. 8,869,674 B2, with a needle valve for adjusting the gas flow.

Solutions in which gas pressure selectors are attached by means of threads preclude the economically-required low production costs as a result of the elaborate and expensive production of threads. Also disadvantageous in terms of manufacturing costs are multi-part gas pressure selectors, which are the result of the higher outlay required in production.

Additionally disadvantageous are gas pressure selector variants that allow unnoticed, unintentional adjustment and thus modification of the gas flow. In particular, those gas pressure selectors that can be inadvertantly set to "zero flow", meaning that automatic reloading would be disabled, and would be particularly disadvantageous in field use.

There is thus a need for a solution which, enables the most cost-effective and economical production of the firearm, preferably has only a small number of components, and can be used with both direct and indirect actuation. The present disclosure is directed to a gas pressure selector and gas diversion system that is not only economical to produce, but provides reliable operation and is easy to clean, as well as firearms that incorporate such gas diversion systems.

The disclosures of U.S. Pat. Nos. 7,610,844, 7,856,917, 8,393,259, 8,596,185, 8,813,632, 8,869,674, 9,170,061, 9,335,106, 9,410,756, 9,459,061, 9,803,941, and publication nos 2016/033218 and 2017/321978 are hereby incorporated by reference for all purposes.

SUMMARY

The present disclosure is directed to gas-operated firearms, and in particular to gas-operated firearms that include a barrel having a gas discharge bore, and a gas block mounted to the barrel, where the gas block includes a lower gas bore fluidly connected to the gas discharge bore, and an upper gas bore configured to convey expanding gas received from the lower gas bore to a gas reloading system of the firearm. The gas block additionally includes a gas pressure selector that is rotatable about a primary axis within the gas block to at least two predetermined positions, the gas pressure selector defining at least two selector bores having different diameters. The gas block additionally includes a stop pin fixed transverse to the primary axis and disposed so that upon rotation of the gas pressure selector about the primary axis, an interaction between the stop pin and a complementary control surface formed on the gas pressure selector translates the gas pressure selector along the primary axis as it rotates.

The gas block additionally includes a locking device including a spring-loaded locking pin that is configured to interact with the gas pressure selector to reversibly lock the gas pressure selector in one or more of its at least two predetermined positions, and further configured to yield in a direction normal to the primary axis as the gas pressure selector rotates along the primary axis. The disclosed gas block and its associated firearm are configured so that when the gas pressure selector is reversibly locked in one of its at least two predetermined positions, the lower gas bore is fluidly connected to the upper gas bore via one of the at least two selector bores defined by the gas pressure selector.

In selected embodiments, the disclosed firearm and firearm gas system can include:

- A gas pressure selector pivotable about an axis and axially displaceable in the longitudinal direction.
- A gas pressure selector having a locking system to enable selecting at least two positions of the gas pressure selector, but where undefined intermediate positions cannot be set.
- A gas pressure selector having at least two end stops for its rotary movement and two end stops for its axial movement.

As a result, the number of bores to be set can be significantly increased without the recognizability of the setting suffering, and the desired bore can be set without any tools, since each uniquely selectable position of the gas pressure selector corresponds to gas bore of an accordingly-designed diameter associated with this position, in order to adjust the gas flow and consequently to adjust the gas pressure in the gas tube and/or gas piston through which the gas subsequently flows. As a result, the cadence of the firearm is adjusted, and it is possible to avoid excessive gas pressures and thus unwanted high mechanical loads.

Furthermore, when the axis of the gas pressure selector is arranged parallel to the bore axis of the barrel, and a flag-shaped handle for the gas pressure selector is used, the current position of the selector (front-rear, left-right at four positions) can be felt by touch from both sides and "blind"—while excellent visibility is provided as well. The "flag" can by designed with haptic elements such as grooves, projections, etc. to offer a secure grip in the field even in wet conditions and when gloves are worn.

BRIEF DESCRIPTION OF THE DRAWINGS

FIG. 5A provides a left side elevation view; FIG. 5B provides a front elevation view; FIG. 5C provides a right side elevation view; FIG. 5D provides a top plan view; and FIG. 5E provides a perspective view.

DETAILED DESCRIPTION

Figure 1:
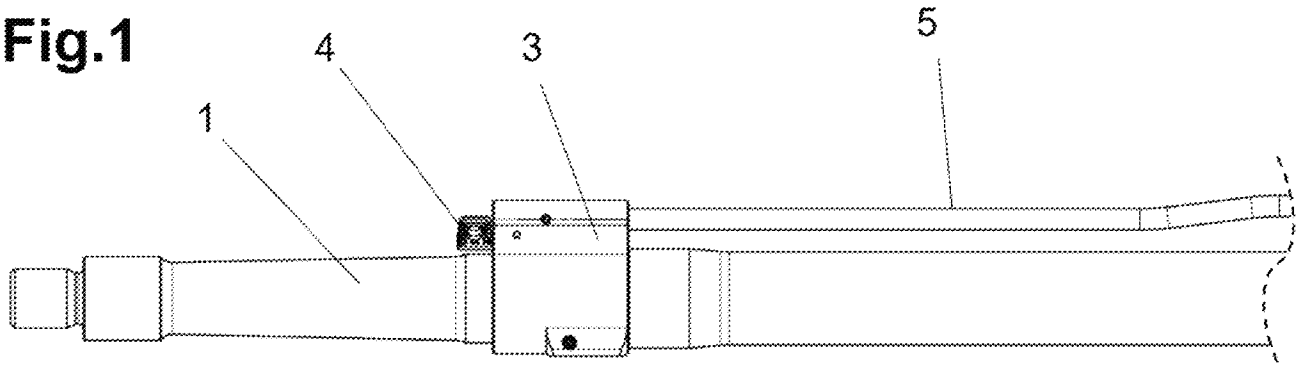
FIG. 1 shows a firearm barrel equipped with an illustrative gas system according to the present disclosure.

FIG. 1 shows an illustrative weapon according to the present disclosure having a typical barrel 1 with a gas block 3 installed neared the muzzle, and a gas tube 5 of a gas-operated reloading system.

Figure 2:
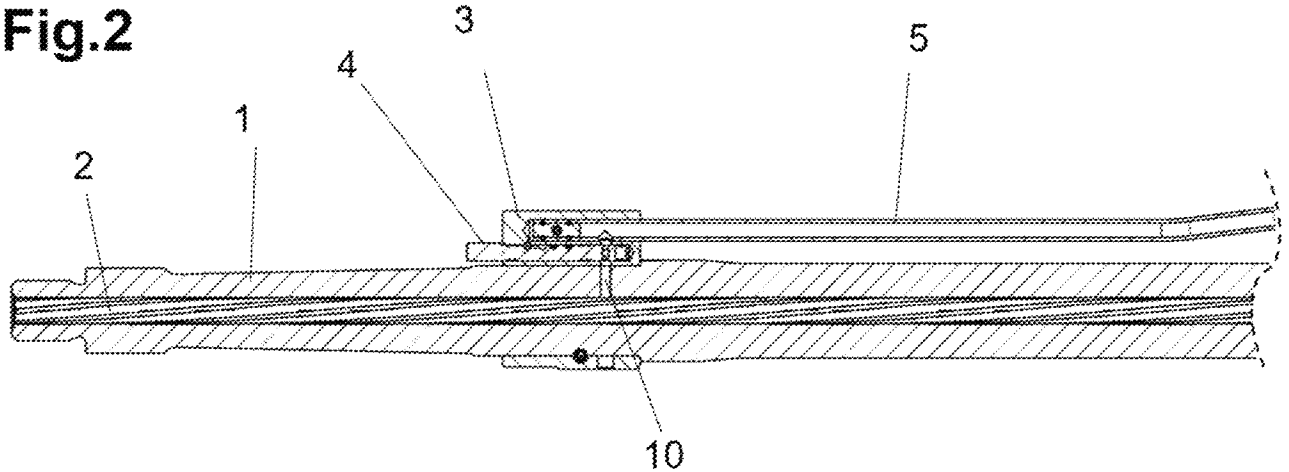
FIG. 2 is a cross-section view of the barrel and the gas block of the gas system of FIG. 1, where the section is taken along the center plane of the weapon.

FIG. 2 shows the section corresponding to FIG. 1 in the center plane of the weapon; the barrel 1 with the barrel bore 2 and a gas discharge bore 10 through gas can flow from the barrel 1 into the gas block 3 with a gas pressure selector 4, and subsequently into the gas tube 5, are clearly visible.

Figure 3:
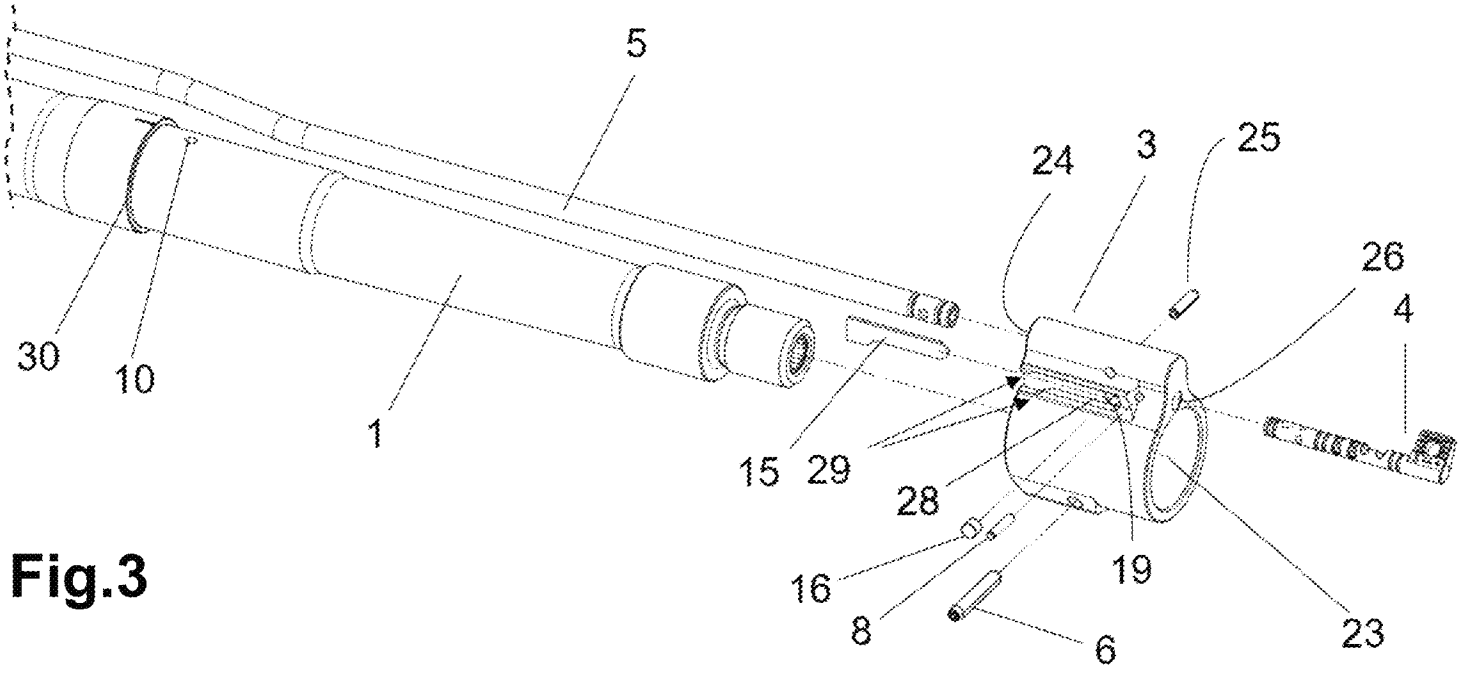
FIG. 3 shows the gas block of FIG. 1 in an exploded view.
Figure 4:
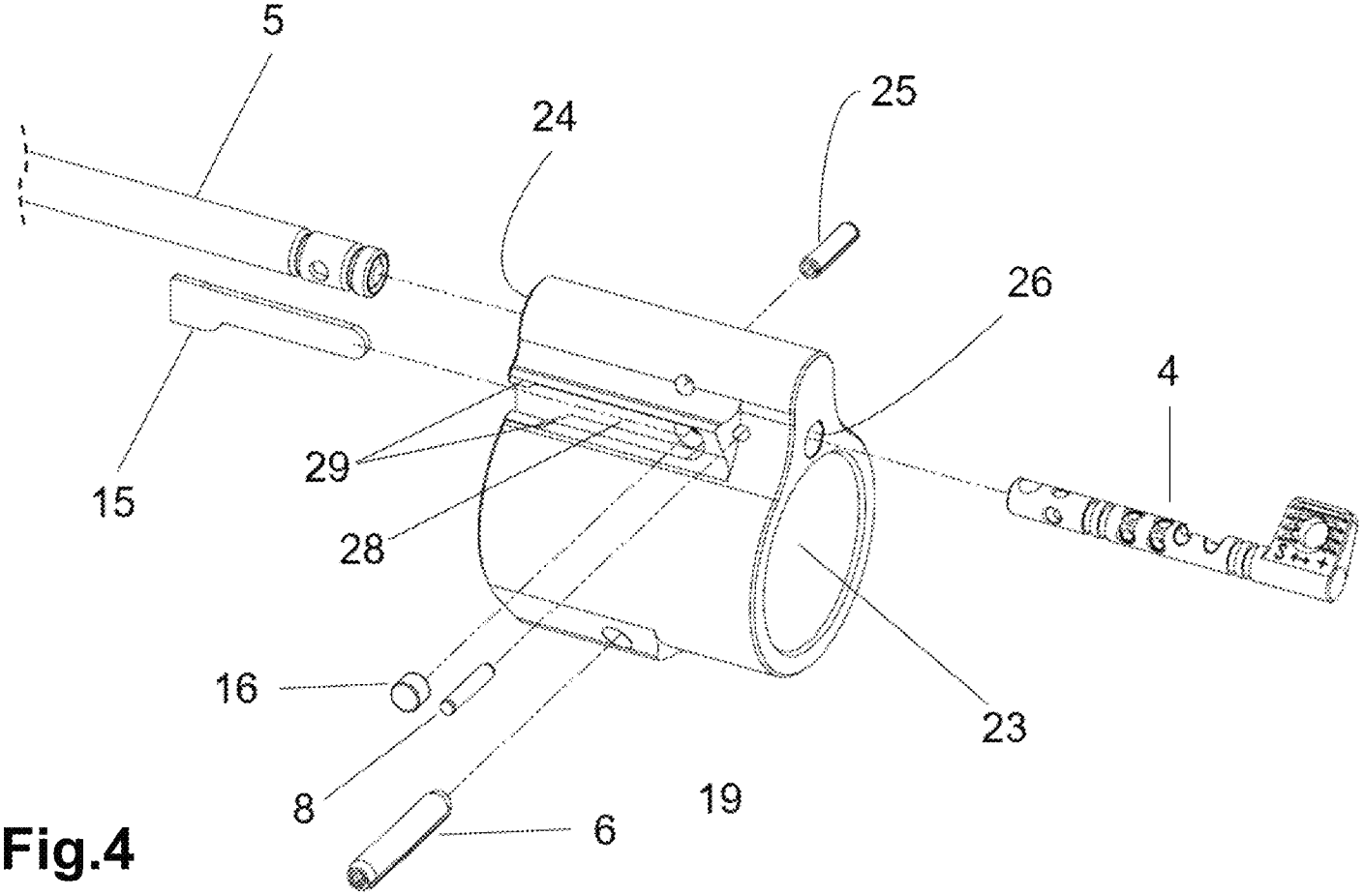
FIG. 4 shows the exploded gas block of FIG. 3 at larger scale.

The gas block 3, shown in FIGS. 3 and 4, has a barrel holder 23 for the barrel 1 at the location of the gas discharge bore 10. An edge 30 on the barrel serves as a stop for the same. The gas block 3 further includes a gas tube holder 24 for the gas tube 5. By means of a holding device 6, the gas block 3 coming to rest against the edge 30 is fastened to the barrel 1—and to the gas tube 5 by means of a gas tube retaining pin 25. The substantially circular-cylindrical gas pressure selector 4 fits into a circular-cylindrical selector recess 26 of the gas block provided for this purpose. It is held in position (against loss) by a stop pin 8, without affecting the (limited) mobility of the gas pressure selector 4 in the axial direction and in the circumferential direction, as explained below.

A locking pin 16 is located in a recess 19 of the gas block 3 and is held in position by a leaf spring 15. This in turn is mounted on its wider (rear) end through undercuts 29 of the gas block 3 on the same, and its thinner (front) end can yield elastically to the outside. In the mounted state, the front face of the wider end of the leaf spring rests on the edge 30 and is fixed in this way.

Figure 5A:
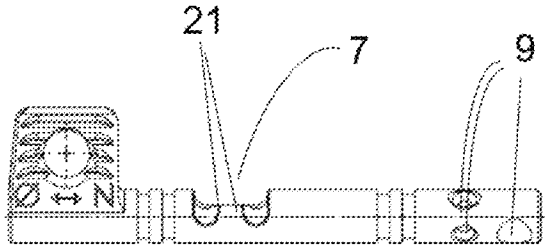
FIGS. 5A-5E depict an illustrative gas pressure selector according to the present disclosure in different orientations.
Figure 5B:
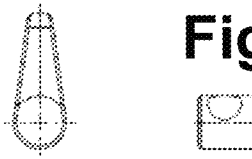
Figure 5C:
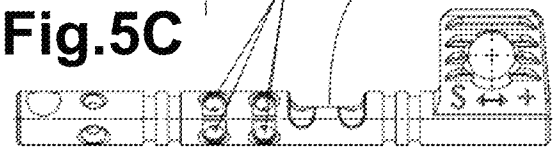
Figure 5D:
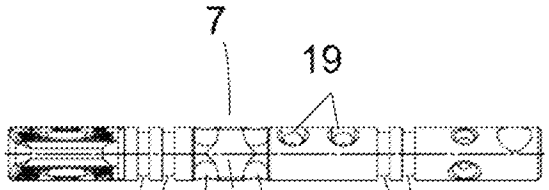
Figure 5E:
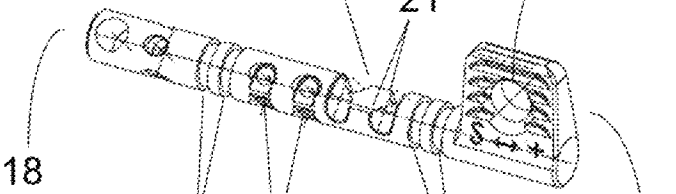

FIGS. 5A-5D show different normal projections of a possible embodiment of the gas pressure selector 4; while FIG. 5E provides a perspective view. The gas pressure selector 4, also called a selector for short, has a substantially circular cylindrical shape. The deviations from the circular cylindrical shape consist of bores, annular grooves, flattenings, deviations which are grouped under the term "control surface 7", and the like, whose function will be explained below, and of a first end (head 17) designed as a handle, which in the embodiment shown gives the selector the shape of a flag. The head 17 has a haptic surface structure 27.

The control surface 7 consists of a central surface 20, locking bumps 21, and grooves 22. In the assembled state, these grooves 22 limit, in cooperation with the stopper pin 8, the axial and tangential movement of the selector in the gas block.

Axially opposite the head 17, near the opposing end 18 of the selector 4, there are at least two, preferably four, selector bores 9 with different diameters, the axes of which, extending radially to the selector—for example, crosswise, and preferably at an angle lower than 90°—are mounted to be axially spaced in pairs. The different diameters result in different gas flows through the gas pressure selector 4, and thus different, resulting gas pressures in the gas tube 5. In order to reach the setting "zero gas flow", there is an arrangement of solid material rather than a selector bore 9 with a through-bore. The term 'selector bore 9' in the present description and claims also includes this arrangement with no bore (or a bore with a diameter which is zero). In the illustrated example, the gas pressure selector 4 therefore has four selector bores 9, for the "normal" positions, for the use of standard ammunition, "large"—for example, for the use of training ammunition—"low"—for example, for the use of a silencer or ammunition with a particularly powerful charge—and "zero", to prevent automatic loading. If necessary, the number of possible positions can be increased by adding further selector bores 9, staggered both in the axial direction (by enlarging the control surface 7 and adding further grooves 22), as well as—independently thereof and combinable in any way—by additional selector bores 9 constructed normal to the primary axis of the gas pressure selector 4. One recess 19, which forms a catch, is functionally assigned to each existing selector bore 9.

The seal tightness of the gas pressure selector 4 can be increased by means of a seal 14—for example, having sealing rings, or designed as a gap/labyrinth seal as in the illustrated embodiment. Such seals 14 may, as shown, be disposed in the forward region near the muzzle, in the rearward end region, and/or in a region in the center of the gas pressure selector 4.

Figure 6:
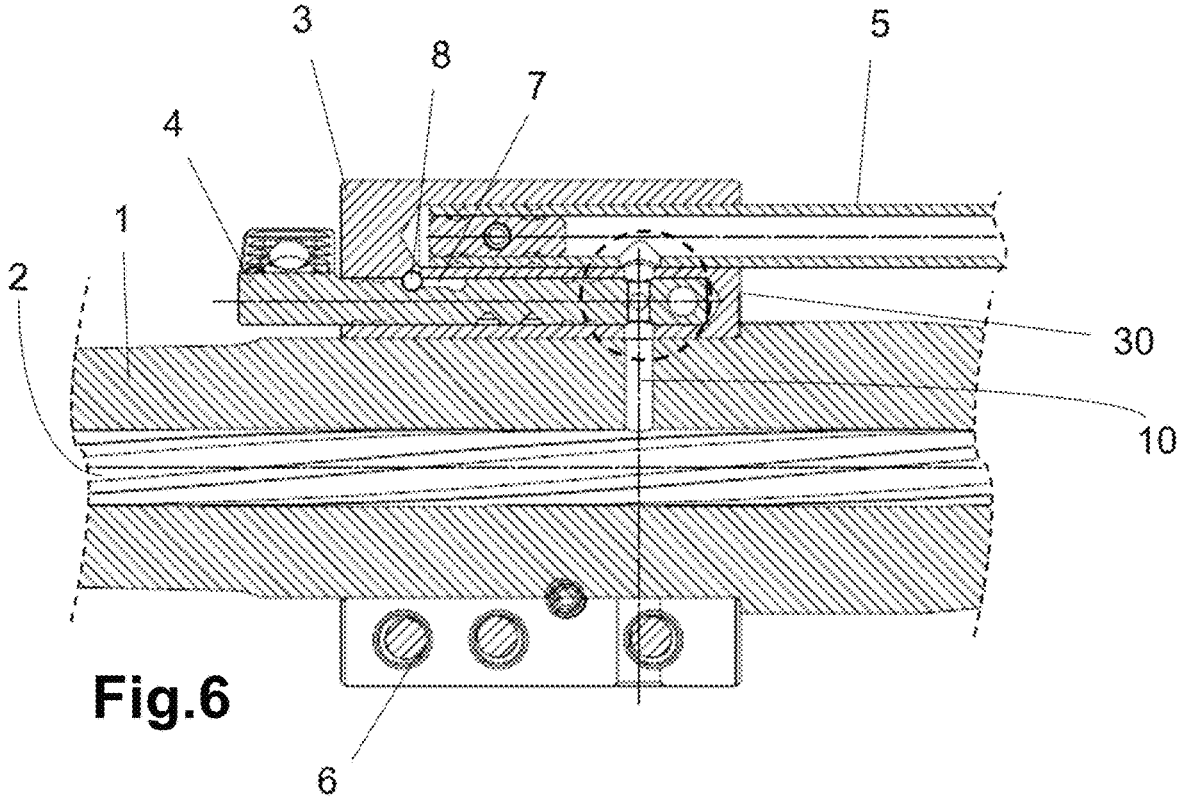
FIG. 6 shows a detailed view of the cross-section of FIG. 2 on an enlarged scale.
Figure 7:
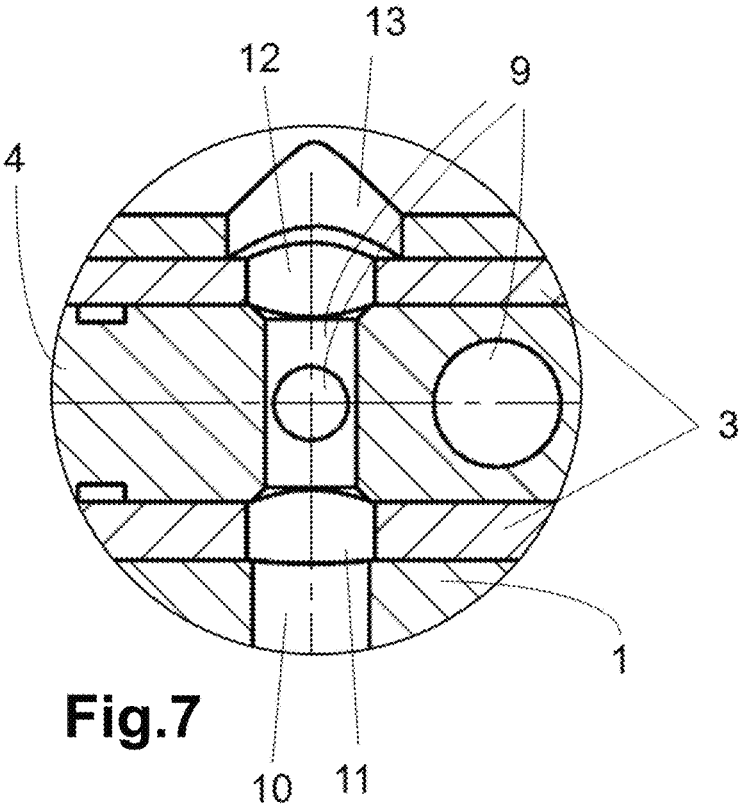
FIG. 7 shows a detail view of the selector bores of a gas pressure selector of the present disclosure.

The functional principle according to the present disclosure can be summarized as follows:

In the initial state, a cartridge is located in the cartridge chamber (not depicted) of the barrel 1. After a shot is fired, the projectile, driven by the gas pressure of the propellant charge, moves in the barrel bore 2 in the direction of the muzzle. After the projectile has passed the gas discharge bore 10 (FIGS. 6-7), a portion of the combustion gases generated by the combustion of the propellant charge flows through the gas discharge bore 10 into an immediately-adjacent lower gas bore 11 of the gas block 3, through the "current" selector bore 9 to and through an upper gas bore 12 of the gas block 3, and then through the gas tube bore 13 into the interior of the gas tube 5 (FIG. 6 and detail view in FIG. 7).

The gas flow from the barrel 1 into the gas tube 5 via the gas block 3 is regulated, as already stated, by selecting one of the at least two selector bores 9. The diameters of the selector bores 9 are smaller or at most equal to the diameter of the gas discharge bore 10, the lower gas bore 11, the upper gas bore 12, and the gas tube bore 13, and thus determine the gas flow and the resulting gas pressure in the gas tube 5. A small diameter results in lower gas flow (for example, cartridges with a greater propellant charge) and lower resulting gas pressure in the gas tube 5. At the same time, a larger diameter results in a greater gas flow and accordingly higher gas pressure (for use, for example, with cartridges with a smaller propellant charge).

The gas pressure selector 4 is axially movable within limits and can rotate about its primary axis within limits. The tangential ends of the grooves 22 each form one end stop for the rotation of the gas pressure selector 4. According to the invention, the movement of the gas pressure selector 4 in the circumferential direction is guided by the stop pin 8 along and/or within the grooves 22 and is likewise also limited axially and tangentially by the ends of the groove 22. Locking bumps 21, best seen in FIG. 5E, allow movement in the longitudinal direction only when the gas pressure selector 4 is rotated in the circumferential direction into the (tangential) center position. In this center position, the locking bumps 21 allow the relative movement of the stop pin 8 axially (in the longitudinal direction). A movement of the gas pressure selector 4 with respect to the stop pin 8 is thus only possible along the (entire) control surface 7.

The permitted/permissible/possible movement sequence for an adjustment of the gas pressure selector 4 is thus defined by a complementary (in shape and function) interaction of the stop pin 8 with the control surface 7. The result in the illustrated embodiment corresponds (substantially) to the movement of an H-shifter with four possible positions. In each of these possible positions, a selector bore 9 is in alignment with the gas discharge bore 10, the lower gas bore 11, the upper gas bore 12 and the gas tube bore 13 (see FIG. 7). The diameter of the activated selector bore 9 determines the gas flow and the resulting gas pressure in the gas tube 5. In the case of "no gas flow", there is no bore at the corresponding point and the gas flow is thus completely interrupted.

A locking pin 16 (FIG. 3) protrudes into one of the recesses 19 of the selector and is compelled by a spring against the gas pressure selector 4. Various springs can be used; in the illustrated embodiment, the locking pin 16 is held in position by a leaf spring 15. The leaf spring 15 is mounted to be at least partially deflectable into a spring recess 28 of the gas block 3 radially with respect to the primary axis of the gas pressure selector 4. The leaf spring 15 is prevented from making a radial movement and a movement in the circumferential direction in the gas block 3 by undercuts 29, and, in an installed condition, is also fixed axially by means of the edge 30 of the barrel 1.

Upon movement of the gas pressure selector 4 and setting of a desired new (or next) position, the locking pin 16 is pushed down against the force of the leaf spring 15 out of the respective recess 19 upon rotation of the selector and is automatically pushed into the specifically selected new (or next) recess 19 past the center position corresponding to the diameter of the gas pressure selector 4 (in which the axial movement—and therefore also only when intentional—is possible). An unintentional adjustment of the gas pressure selector 4 is thus prevented by the spring-loaded locking pin. In other words: Each selectable position of the selector bores 9 of the gas pressure selector 4 brings the locking pin 16 into the respective, associated, defined locking position by bringing the locking pin 16 into a coinciding position with the respective, associated recess 19.

According to the number of selector bores 9, there is one corresponding recess 19—each of which serves, in the installed state, as an automatically-latching arrest position for the locking pin 16. Each recess individually centers the respectively assigned selector bore 9 with the gas discharge bore 10, the lower gas bore 11, the upper gas bore 12 and the gas tube bore 13 (and brings/aligns these into one line), therefore enabling gas flow through the respective selector bores 9 with the appropriate diameter.

This automatic latching is affected by the shape of the contact surface for the locking pin, which is forced by the spring force to the center (axis) of the selector. This contact surface is then farther away from the axis between the working positions, such that the locking pin also exerts a force (torque) on the selector in the circumferential direction by means of the spring force, thus compelling it into a working position. The same applies, mutatis mutandis, to the axial displacement in which the shape of the control surface prevents dwelling in an intermediate position.

The material and surface of the seal 14 may be such that a self-sealing effect is facilitated. Such facilitative surface- and material properties can be achieved, for example, by a surface structure forming a gap or labyrinth seal, a tapered conical surface, a tapered bearing, by using composite material and/or sealing rings, and/or a combination of these and others.

The gas pressure selector can be actuated without tools and with one hand, from both sides. It may have one or more improved, haptic surface structures 27 to enable adjustment without slipping and, optionally, with the aid of a simple auxiliary means, such as a cartridge. Its flag shape clearly and unambiguously signals its position visually and haptically.

The improved haptic surface structuring 27 is shown with anti-slip notches and a central bore into which, for example, the projectile side of a cartridge engages. This is advantageous particularly when used in the field in adverse weather conditions (e.g., cold, wet) and when using gloves.

The invention is of course not limited to the exemplary embodiment shown, and other embodiments are possible. For example, by means of additional grooves between the two grooves 22, additionally selectable positions can be added. This can also be achieved, for example, via additional bores at the same axial position.

The gas pressure selector can, for example, also be formed like a sleeve in or around the gas tube 5, and the locking means can also be designed otherwise according to the prior art. The positioning in the gas block can be parallel or normal to the barrel axis.

The gas pressure selector 4 according to the invention can be used both in a direct gas system (direct impingement) and also for indirect gas systems, adapted by a person skilled in the art according to the examples shown above—such as for gas piston systems.

The following numbered paragraphs describe selected additional aspects and features of the gas-operated firearms of the present disclosure. Each of these paragraphs can be combined with one or more other paragraphs, and/or with disclosure from elsewhere in this application, including materials incorporated by reference, in any suitable manner. Some of the paragraphs below expressly refer to and further limit other paragraphs, providing without limitation examples of some of the suitable combinations.

A1. A firearm, in particular a carbine, with gas-operated reloading, comprising a barrel 1 having a gas discharge bore 10 which is fluidly connected to a lower gas bore 11, to a selector bore 9 and to an upper gas bore 12 of a gas block 3 and which conveys expansion gas into a gas system, wherein the gas block 3 comprises a gas pressure selector 4 movable between at least two positions, in which at least two selector bores 9 with different diameters are provided, and wherein a locking device for the gas pressure selector 4 is provided, characterized in that the gas pressure selector 4 in the gas block 3 is rotatable into at least two positions about its primary axis and is designed to be axially displaceable along the same between at least two positions, in that a stop pin 8 is arranged transversely to the primary axis, fixed in the gas block 3, upon intentional displacement and/or rotation of the gas pressure selector 4 cooperate with a control surface 7 of the gas pressure selector 4 with complementary form and function, and in that the locking device has a spring-loaded locking pin 16 which can yield normally to the primary axis to temporarily lock the gas pressure selector 4 in a predetermined position.

A2. The firearm according to paragraph A1, characterized in that the control surface 7 has at least two grooves 22, as well as at least two locking bumps 21, and at least one central surface 20 which connects the at least two grooves 22.

A3. The firearm according to paragraph A2, characterized in that the stop pin 8, upon intentional displacement of the gas pressure selector 4, cooperates with the control surface 7 with complementary form and function, such that the permissible movement of the gas pressure selector 4 substantially corresponds to the movement pattern of an H-shifter.

A4. The firearm according to any one of the paragraphs A1 to A3, characterized in that the gas pressure selector 4 is elongated, has a head 17 at one end, and has an end 18 on the other end region, in that the head 17 is larger in cross-section than the end 18 and is larger than the diameter of a selector recess 26 in the gas block 3, and in that the end 18 is smaller in diameter than the diameter of the selector recess 26.

A5. The firearm according to any one of the preceding paragraphs, characterized in that the head 17 is shaped like a flag.

A6. The firearm according to any one of the preceding paragraphs, characterized in that the selector bores 9 are formed in crosswise pairs positioned at an angle greater than 30°, preferably greater than 60° and particularly preferably equal to 90° to each other.

A7. The firearm according to any one of the preceding paragraphs, characterized in that the selector bores 9 are constructed at an axial distance of at least ¼, preferably at least ⅓, of the diameter of the gas discharge bore 10.

A8. The firearm according to any one of the preceding paragraphs, characterized in that the head 17 of the gas pressure selector 4 has a haptic surface structure 27 and preferably has at least one slip notch and/or recess to engage with a cartridge tip.

A9. The firearm according to any one of the preceding paragraphs, characterized in that selector bores 9 are each functionally assigned to a recess 19 and are formed on the gas pressure selector 4 in such a manner that, when a predetermined position of the gas pressure selector 4 is selected, the selected selector bore 9 comes into alignment with the upper gas bore 12, the lower gas bore 11, and the gas discharge bore 10, and in that the spring-loaded locking pin 16 guides the gas pressure selector 4 into the respective, predetermined position in a self-centering manner, temporarily locking the same in this position in the respective, prespecified recess 19.

A10. The firearm according to any one of the preceding paragraphs, characterized in that an axis through the recess 19 for the locking pin 16 has an angle of >60° and <90° relative to the axis of the gas discharge bore 10.

A11. The firearm according to any one of the preceding paragraphs, characterized in that the locking pin 16 is biased by a leaf spring 15 in the direction of the primary axis of the gas pressure selector 4.

A12. The firearm according to paragraph 11, characterized in that the gas block 3 has at least one undercut 29 in the region of a spring recess 28 for receiving the leaf spring 15.

A13. The firearm according to any one of the preceding paragraphs, characterized in that the barrel 1 has an edge 30, which preferably runs completely around the circumference thereof, to axially fix the gas block 3 and/or a spring element—in particular, the leaf spring 15.

A14. The firearm according to any one of the preceding paragraphs, characterized in that the gas pressure selector 4 is formed substantially as a circular cylinder between its end portions 17, 18.

A15. The firearm according to any one of the preceding paragraphs, characterized in that either a gas tube 5 of a direct gas system or a gas cylinder of a gas cylinder system is fluidly connected to the gas block 3.

In the description and claims, the terms "forward", "rearward", "top", "bottom" and so on are used in the common form and with reference to the object in its normal position of use. This means that, in the case of a weapon, the muzzle of the barrel is "forward", the breech or bolt carrier is moved "rearward" by the explosion gases, etc.

The present disclosure may be applied to any automatic or semi-automatic firearm, but is most applicable to long guns, such as rifles, carbines, and shotguns.

It should also be noted that, in the description and claims, indications such as "lower region" of a flank, reactor, filter, building, or a device or, more generally, an object, refer to the lower half and particularly to the lower quarter of the total height; "lowermost region" refers to the bottom quarter, and particularly to an even smaller portion; and "center region" refers to the middle third of the total height (width–length). All these indications have their general meaning, applied to the appropriate position of the object viewed (or its specially indicated position).

In the description and claims, "substantially" refers to a deviation of up to 10% of the stated value, if it is physically possible, both downwards and upwards, and otherwise only in the meaningful direction; for degree specifications (angle and temperature), ±10° shall apply.

Unless they relate to the specific examples, all specifications regarding quantities and portions, particularly those for delimiting the invention, are supposed to indicate a ±10% tolerance, for example: 11% means: from 9.9% to 12.1%. For terms such as "a solvent", the word "a" is not to be regarded as a numerical word but as an indefinite article or as a pronoun, unless the context indicates otherwise.

The term: "combination" or "combinations" means, unless otherwise stated, all types of combinations, starting from two of the relevant constituents, to a plurality or all of such constituents, the term "containing" also means "consisting of".

The features and variants specified in the individual embodiments and examples can be freely combined with those of the other examples and embodiments and in particular be used to characterize the invention in the claims without necessarily implying the other details of the respective embodiment or the respective example

LIST OF REFERENCE NUMERALS

1 Barrel
2 Barrel bore
3 Gas block
4 Gas pressure selector
5 Gas tube
6 Holding device
7 Control surface
8 Stop pin
9 Selector bore
10 Gas discharge bore (barrel)
11 Lower gas bore (gas block)
12 Upper gas bore (gas block)
13 Gas tube bore
14 Seal (gap seal)
15 Leaf spring
16 Locking pin
17 Head
18 Opposing End
19 Recess (for locking pins)
20 Center surface
21 Locking bump
22 Groove (for stop pin)
23 Barrel holder
24 Gas tube holder
25 Gas tube retaining pin
26 Selector recess

27 Haptic surface structure
28 Spring recess
29 Undercut
30 Edge

The invention claimed is:

1. A gas-operated firearm, comprising:

a barrel having a gas discharge bore; and a gas block mounted to the barrel;

wherein the gas block includes:

a lower gas bore fluidly connected to the gas discharge bore, and an upper gas bore configured to convey expanding gas received from the lower gas bore to a gas reloading system of the firearm;

a gas pressure selector that is rotatable about a primary axis within the gas block to at least two predetermined positions, the gas pressure selector defining at least two selector bores having different diameters;

a complementary control surface formed on the gas pressure selector, the complementary control surface including at least two grooves and at least two locking bumps, and at least one central surface that connects the at least two grooves;

a stop pin fixed transverse to the primary axis and disposed so that upon rotation of the gas pressure selector about the primary axis, an interaction between the stop pin and the complementary control surface formed on the gas pressure selector translates the gas pressure selector along the primary axis as it rotates; and a locking device including a spring-loaded locking pin that is configured to interact with the gas pressure selector to reversibly lock the gas pressure selector in one or more of its at least two predetermined positions, and further configured to yield in a direction normal to the primary axis as the gas pressure selector rotates along the primary axis;

such that when the gas pressure selector is reversibly locked in one of its at least two predetermined positions, the lower gas bore is fluidly connected to the upper gas bore via one of the at least two selector bores defined by the gas pressure selector.

2. The firearm of claim 1, where the firearm is an automatic or semi-automatic rifle.

3. The firearm according to claim 1, wherein upon intentional displacement of the gas pressure selector, the stop pin cooperates with the complementary control surface such that a permissible movement of the gas pressure selector substantially corresponds to a movement pattern of an H-pattern shifter.

4. The firearm according to claim 1, wherein the gas pressure selector is elongate and fits within a corresponding selector recess defined by the gas block;

the elongate gas pressure selector including a first end and an opposing end, where the gas pressure selector has a head disposed at the first end, where the head is larger in cross-section than the opposing end of the gas pressure selector, and larger than a diameter of the selector recess in the gas block; and the opposing end of the gas pressure selector is smaller in diameter than the diameter of the selector recess in the gas block.

5. The firearm according to claim 4, wherein the head of the gas pressure selector is shaped like a flag.

6. The firearm according to claim 4, wherein the head of the gas pressure selector includes one or more haptic surface structures.

7. The firearm according to claim 4, wherein the head of the gas pressure selector includes at least one slip notch and/or recess that is configured to engage with a cartridge tip.

8. The firearm according to claim 1 wherein the at least two selector bores are formed in crosswise pairs positioned at an angle greater than 60° to each other.

9. The firearm according to claim 1 wherein the at least two selector bores are formed in crosswise pairs positioned at an angle substantially equal to 90° to each other.

10. The firearm according to claim 1, wherein the at least two selector bores are disposed in the gas pressure selector at an axial distance from each other of at least one-quarter of a diameter of the gas discharge bore.

11. The firearm according to claim 1, wherein the at least two selector bores are disposed in the gas pressure selector at an axial distance from each other of at least one-third of a diameter of the gas discharge bore.

12. The firearm according to claim 1, wherein the gas pressure selector further defines a recess corresponding to each defined selector bore, such that when the gas pressure selector is in one of its at least two predetermined positions the spring-loaded locking pin interacts with the corresponding recess to guide the gas pressure selector into the predetermined position in a self-centering manner, temporarily and reversibly locking the spring-loaded locking pin in the corresponding recess, such that the selector bore corresponding to the predetermined position comes into alignment with the upper gas bore, the lower gas bore, and the gas discharge bore.

13. The firearm according to claim 12, wherein when the locking pin is temporarily and reversibly locked in one or the corresponding recesses, the locking pin defines a locking pin axis through the corresponding recess having an angle of more than 60° and less than 90° relative to an axis defined by the gas discharge bore.

14. The firearm according to claim 1, wherein the locking pin is biased by a leaf spring in a direction of the primary axis of the gas pressure selector.

15. The firearm according to claim 14, wherein the gas block defines a spring recess configured to receive the leaf spring, the spring recess including at least one undercut in a region of the spring recess.

16. The firearm according to claim 14, wherein the barrel includes an edge configured to axially fix the gas block and/or the leaf spring.

17. The firearm according to claim 16, wherein the edge of the barrel preferably extends completely around a circumference of the barrel.

18. The firearm according to claim 1, wherein the gas pressure selector is shaped substantially as a circular cylinder between its first end and its opposing end.

19. The firearm according to claim 1, wherein the upper gas bore of the gas block is fluidly connected to a gas tube of a direct gas reloading system of the firearm, or is fluidly connect to a gas cylinder of a gas cylinder reloading system of the firearm.

* * * * *